US008371889B2

(12) United States Patent
Kure et al.

(10) Patent No.: US 8,371,889 B2
(45) Date of Patent: Feb. 12, 2013

(54) SPARK PLUG MANUFACTURING METHOD AND SPARK PLUG MANUFACTURING APPARATUS

(75) Inventors: Keisuke Kure, Konan (JP); Masahiro Enuma, Inuyama (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 13/120,557

(22) PCT Filed: Oct. 2, 2009

(86) PCT No.: PCT/JP2009/067232

§ 371 (c)(1),
(2), (4) Date: Mar. 23, 2011

(87) PCT Pub. No.: WO2010/041599

PCT Pub. Date: Apr. 15, 2010

(65) Prior Publication Data

US 2011/0171870 A1 Jul. 14, 2011

(30) Foreign Application Priority Data

Oct. 6, 2008 (JP) ..... 2008-260016

(51) Int. Cl.
*H01T 21/02* (2006.01)

(52) U.S. Cl. ..... 445/7; 313/141; 313/142

(58) Field of Classification Search ..... 445/7; 313/141, 313/142

See application file for complete search history.

(56) References Cited

U.S. PATENT DOCUMENTS

| | | | | |
|---|---|---|---|---|
| 6,790,113 | B1 | 9/2004 | Fujita | |
| 2002/0094743 | A1 * | 7/2002 | Harada | 445/7 |
| 2004/0012318 | A1 | 1/2004 | Ishikawa | |
| 2005/0039332 | A1 | 2/2005 | Oda et al. | |
| 2005/0042965 | A1 | 2/2005 | Oda et al. | |

FOREIGN PATENT DOCUMENTS

| | | | |
|---|---|---|---|
| JP | 2000-164320 | A | 6/2000 |
| JP | 2004-055142 | A | 2/2004 |
| JP | 2004-253377 | A | 9/2004 |
| JP | 2005-063893 | A | 3/2005 |
| JP | 2005-100938 | A | 4/2005 |

* cited by examiner

*Primary Examiner* — Bumsuk Won
(74) *Attorney, Agent, or Firm* — Sughrue Mion, PLLC

(57) ABSTRACT

A method and an apparatus for manufacturing a spark plug. A bending apparatus includes a bending unit having a preliminary bending unit and a main bending unit, and a gap adjusting unit. The main bending unit including pressing unit for pressing a distal end of a ground electrode toward a center electrode, and a gap adjusting unit configured to adjust a relative height position of the distal end of the ground electrode relative to a distal end of the center electrode in an axis line direction. The gap adjusting unit includes a gap adjusting unit for relatively moving the distal end of the ground electrode relative to the center electrode in a direction substantially perpendicular to the axis line direction, and a restricting unit for restricting relative movement of the distal end of the ground electrode relative to the center electrode in the axis direction.

14 Claims, 8 Drawing Sheets

SPARK PLUG MANUFACTURING METHOD AND SPARK PLUG MANUFACTURING APPARATUS

TECHNICAL FIELD

The present invention relates to a manufacturing technique for spark plugs for use in internal combustion engines and more particularly to a method and apparatus for manufacturing spark plugs which are characterized by a bending process of a ground electrode.

BACKGROUND ART

A spark plug for use in an internal combustion engine such as an automotive engine includes a center electrode extending in an axis line direction, for example, an insulator provided on an outside of the center electrode, a cylindrical metal shell provided on an outside of the insulator and a ground electrode joined to a front end portion of the metal shell at a proximal end portion thereof. In general, the ground electrode is bent so that a distal end portion thereof faces a front end portion of the center electrode when the ground electrode is disposed as designed, whereby a spark discharge gap is formed between the front end portion of the center electrode and the distal end portion of the ground electrode for a spark to be discharged in the spark discharge gap defined almost in an axis line of the spark plug. Here, in the case of the spark discharge gap being too large, there is a fear that an increase in required voltage is called for, whereas in the case of the spark discharge gap being too small, there is a fear that a decrease in flame propagation properties is called for. Because of this, the spark discharge gap needs to be adjusted to an appropriate magnitude.

As a method for adjusting the magnitude of a spark discharge gap, there is known a method in which after a bending spacer is disposed so as to face a front end face of a center electrode, by use of a bending punch of which an abutment portion with a ground electrode contact is made into an inclined surface, a preliminary bending step of pressing the ground electrode against the bending spacer is carried out, and thereafter, after the bending spacer is removed, by use of a bending punch having a plat abutment surface, the ground electrode is bent to a predetermined position (refer to Patent Document 1, for example).

Here, in a so-called spark plug of longitudinal discharge type in which a spark is discharged almost in the axis line direction as has been described above, it is possible to adjust the magnitude of the spark discharge gap by use of the aforesaid technique. In recent years, however, with a view to realizing an increase in durability, there have been proposed a so-called spark plug of transverse discharge type in which a distal end portion of a ground electrode is disposed so as to face a side of a center electrode and a so-called spark plug of oblique discharge type in which a distal end portion of a ground electrode is disposed so as to face a front end edge portion of a center electrode. In these types of spark plugs, the magnitude of the spark discharge gap is determined by not only a magnitude thereof defined in the axis line direction but also a magnitude thereof defined in a direction perpendicular to the axis line. Consequently, in the case of adopting the aforesaid technique in which only the magnitude of the spark discharge gap defined in the axis line direction can be adjusted, there is a fear that the magnitude of the spark discharge gap cannot be adjusted with good accuracy.

Then, As shown in FIG. 8, a method is considered in which a magnitude of a spark discharge gap 33 defined in a direction perpendicular to an axis line CL1 of a spark plug is adjusted by use of a gap adjusting unit 83 which moves a ground electrode 27 relative to a center electrode 5 so that the ground electrode 27 moves toward or away from the center electrode 5.

RELATED ART DOCUMENT

Patent Document

Patent Document 1: Japanese Patent No. 3389121

SUMMARY OF THE INVENTION

Problem that the Invention is to Solve

In the case of the aforesaid method being used, however, a magnitude of the spark discharge gap 33 defined in the axis line CL1 is increased or decreased by moving the ground electrode 27 relative to the center electrode 5, leading to a fear that the magnitude of the spark discharge gap 33 cannot be adjusted with sufficient accuracy. Note that this problem is not limited to the spark plugs of transverse discharge and oblique discharge types but is involved in the spark plug of type in which the spark is discharged in the axis line direction.

The invention has been made in view of these situations, and an object thereof is to provide a spark plug manufacturing method and manufacturing apparatus which can form a spark discharge gap with sufficient accuracy.

Means for Solving the Problem

Hereinafter, configurations suitable for attaining the object will be described below item by item. Note that functions and advantages specific to the configurations will be added as required.

Configuration 1, a spark plug manufacturing method for manufacturing a spark plug including:

a center electrode extending in an axis line direction;

a substantially cylindrical insulator having an axial hole extending in the axis line direction, the center electrode being provided at a front end side of the axial hole;

a substantially cylindrical metal shell provided on an outer circumference of the insulator; and a ground electrode which is joined to the metal shell at a proximal end portion thereof and which is bent at an intermediate portion thereof so as to form a spark discharge gap between a distal end portion thereof and a front end portion of the center electrode, the spark plug manufacturing method comprising:

a bending step of pressing the distal end portion of the ground electrode toward the center electrode by a bending member so that the ground electrode is bent to adjust a relative height position of the distal end portion of the ground electrode in the axis line direction relative to the front end portion of the center electrode; and a gap adjusting step of adjusting a magnitude of the spark discharge gap which is defined in a direction perpendicular to the axis line direction by use of an gap adjusting unit for moving the distal end portion of the ground electrode relative to the center electrode, wherein a restricting unit for restricting the relative movement of the distal end portion of the ground electrode relative to the center electrode in the axis line direction is used in the gap adjusting step.

A noble metal tip made of a noble metal alloy may be joined to the front end portion of the center electrode and the distal end portion of the ground electrode. In this case, the noble metal tip forms part of the center electrode and the ground electrode.

According to Configuration 1 described above, in the bending step, the relative height position of the distal end portion of the ground electrode to the front end portion of the center electrode, that is, the magnitude of the spark discharge gap which is defined in the axis line direction is adjusted, and in the gap adjusting step, the magnitude of the spark discharge gap which is defined in the direction perpendicular to the axis line is adjusted. Because of this, the spark discharge gap can be formed with good accuracy.

On the other hand, by adjusting the spark discharge gap defined in the direction perpendicular to the axis line, there is a fear that an error is generated in the magnitude of the spark discharge gap which is defined in the axis line. In this respect, according to Configuration 1, the relative movement of the ground electrode in the axis line direction can be restricted by the restricting unit. Because of this, not only the magnitude of the spark discharge gap which is defined in the direction perpendicular to the axis line but also the magnitude of the spark discharge gap which is defined in the axis line direction can be defined with sufficient accuracy.

Configuration 2: According to this configuration, there is provided a spark plug manufacturing method as set forth in Configuration 1, characterized in that the restricting unit can adjust the magnitude of the spark discharge gap which is defined in the axis line direction.

According to Configuration 2 above, not only can the relative movement in the axis line direction of the ground electrode be restricted, but also the magnitude of the spark discharge gap which is defined in the axis line can be adjusted. Namely, in the gap adjusting step, since the magnitude of the spark discharge gap which is defined in the axis line can also be adjusted in addition to the magnitude of the spark discharge gap which is defined in the direction perpendicular to the axis line, the spark discharge gap can be formed with far greater accuracy.

Configuration 3: According to this configuration, there is provided a spark plug manufacturing method as set forth in Configuration 1 or 2, wherein the restricting unit abuts and slides on a side surface of the distal end portion of the ground electrode opposite to a side of the distal end portion which faces the center electrode to restrict the relative movement of the ground electrode relative to the center electrode, and a layer having a small friction coefficient is formed on a portion of the restricting unit where the ground electrode is brought into abutment and slides.

As in Configuration 3, the relative movement of the ground electrode may be restricted by the relatively simple and easy configuration in which the side surface of the opposite side of the distal end portion of the ground electrode to the side thereof which faces the center electrode is brought into abutment with and slides on the restricting unit. On the other hand, in the restricting unit described above, when the magnitude of the spark discharge gap which is defined in the direction perpendicular to the axis line is adjusted by the gap adjusting unit, the ground electrode frictionally moves relative to the restricting unit, leading to a fear that the ground electrode is damaged.

In this respect, according to Configuration 3 described above, the layer having the small friction coefficient is formed on the portion of the restricting unit where the ground electrode is brought into abutment and slides. Consequently, damaging the ground electrode can be prevented effectively. As the layer having the small friction coefficient, diamond-like carbon is preferred.

Configuration 4: According to this configuration, there is provided a spark plug manufacturing method as set forth in Configuration 1 or 2, wherein the restricting unit is a roller which can rotate, and the relative movement of the distal end portion of the ground electrode relative to the center electrode in the axis line direction is restricted by bringing an outer circumferential surface of the roller into abutment with the side surface of the distal end portion of the ground electrode opposed to the side of the distal end portion which faces the center electrode.

According to Configuration 4, in adjusting the magnitude of the spark discharge gap which is defined in the direction perpendicular to the axis line, the frictional movement of the ground electrode relative to the restricting unit can be prevented in a more ensured fashion. As a result, the damage to the surface of the ground electrode can be prevented in a far more ensured fashion.

Configuration 5: According to this configuration, there is provided a spark plug manufacturing method as set forth in Configuration 1 or 2, wherein the restricting unit is made to be movable in synchronism with movement of the gap adjusting unit.

According to Configuration 5, as with Configuration 4, in adjusting the magnitude of the spark discharge gap which is defined in the direction perpendicular to the axis line, the frictional movement of the ground electrode relative to the restricting unit can be prevented in a more ensured fashion. Because of this, the damage to the surface of the ground electrode can be prevented in a far more ensured fashion.

Configuration 6: According to this configuration, there is provided a spark plug manufacturing method as set forth in any of Configurations 1 to 5, wherein in the spark plug, a shortest distance between the center electrode and the ground electrode is formed between a front end edge portion of the center electrode or a side surface portion of the center electrode and the distal end portion of the ground electrode.

As in Configuration 6, in a so-called spark plug of oblique discharge type in which a shortest distance between a center electrode and a ground electrode is formed a front edge portion of the center electrode and the ground electrode or a so-called spark plug of transverse discharge type in which a shortest distance is formed between a side surface portion of a center electrode and a ground electrode, it is important that the magnitude of the spark discharge gap which is defined in the direction perpendicular to the axis line is adjusted by the gap adjusting unit. Consequently, it is more effective to adopt Configuration 1 above in those types of spark plugs.

Configuration 7: According to this configuration, there is provided A spark plug manufacturing apparatus for use in manufacturing a spark plug including:

a center electrode extending in an axis line direction;

a substantially cylindrical insulator having an axial hole extending in the axis line direction, the center electrode being provided at a front end side of the axial hole;

a substantially cylindrical metal shell provided on an outer circumference of the insulator; and a ground electrode which is joined to the metal shell at a proximal end portion thereof and which is bent at an intermediate portion thereof so as to form a spark discharge gap between a distal end portion thereof and a front end portion of the center electrode, the spark plug comprising:

a bending unit for bending the ground electrode, which has a straight rod shape, toward the axis line so as to adjust a relative height position of the distal end portion of the ground electrode to the front end portion of the center electrode in the axis line direction; and a gap adjusting unit for adjusting a magnitude of the spark discharge gap which is defined in a direction perpendicular to the axis line, wherein the bending unit includes a bending member for pressing the distal end portion of the ground electrode toward the center electrode, and wherein the gap adjusting unit includes:

a gap adjusting unit for moving the distal end portion of the ground electrode relative to the center electrode in a direction substantially perpendicular to the axis line; and restricting unit for restricting the relative movement of the distal end portion of the ground electrode relative to the center electrode in the axis line direction.

As in Configuration 7, the technical concept of Configuration 1 may be embodied into the spark plug manufacturing apparatus. In this case, basically, the same advantage and function as those of Configuration 1 are provided by Configuration 7.

Configuration 8: According to this configuration, there is provided a spark plug manufacturing apparatus as set forth in Configuration 7, characterized in that the restricting unit can adjust the magnitude of the spark discharge gap which is defined in the axis line direction.

According to Configuration 8 above, the same function and advantage as those of Configuration 2 are provided.

Configuration 9: According to this configuration, there is provided a spark plug manufacturing apparatus as set forth in Configuration 7 or 8, wherein the restricting unit abuts and slides on a side surface of the distal end portion of the ground electrode opposite to a side of the distal end portion which faces the center electrode to restrict the relative movement of the ground electrode relative to the center electrode, and a layer having a small friction coefficient is formed on a portion of the restricting unit where the ground electrode is brought into abutment and slides.

According to Configuration 9 above, the same function and advantage as those of Configuration 3 are provided.

Configuration 10: According to this configuration, there is provided a spark plug manufacturing apparatus as set forth in Configuration 7 or 8, wherein the restricting unit is a roller which can rotate, and the relative movement of the distal end portion of the ground electrode to the center electrode in the axis line direction is restricted by bringing an outer circumferential surface of the roller into abutment with the side surface of the distal end portion of the ground electrode opposite to the side of the distal end portion which faces the center electrode.

According to Configuration 10 above, the same function and advantage as those of Configuration 4 are provided.

Configuration 11: According to this configuration, there is provided a spark plug manufacturing apparatus as set forth in Configuration 7 or 8, wherein the restricting unit is made to be movable in synchronism with movement of the gap adjusting unit.

According to Configuration 11 above, the same function and advantage as those of Configuration 5 are provided.

Configuration 12: According to this configuration, there is provided a spark plug manufacturing apparatus as set forth in any of Configurations 7 to 11, wherein in the spark plug, a shortest distance between the center electrode and the ground electrode is formed between a front end edge portion of the center electrode or a side surface portion of the center electrode and the distal end portion of the ground electrode.

As in Configuration 6, in a so-called spark plug of oblique discharge type or a so-called spark plug of transverse discharge type, it is more effective to adopt the restricting unit set forth in Configuration 7 or the like.

BRIEF DESCRIPTION OF THE DRAWINGS

FIG. 5 is an enlarged exemplary view showing a preliminary bending unit and the like.

MODE FOR CARRYING OUT THE INVENTION

Figure 1:
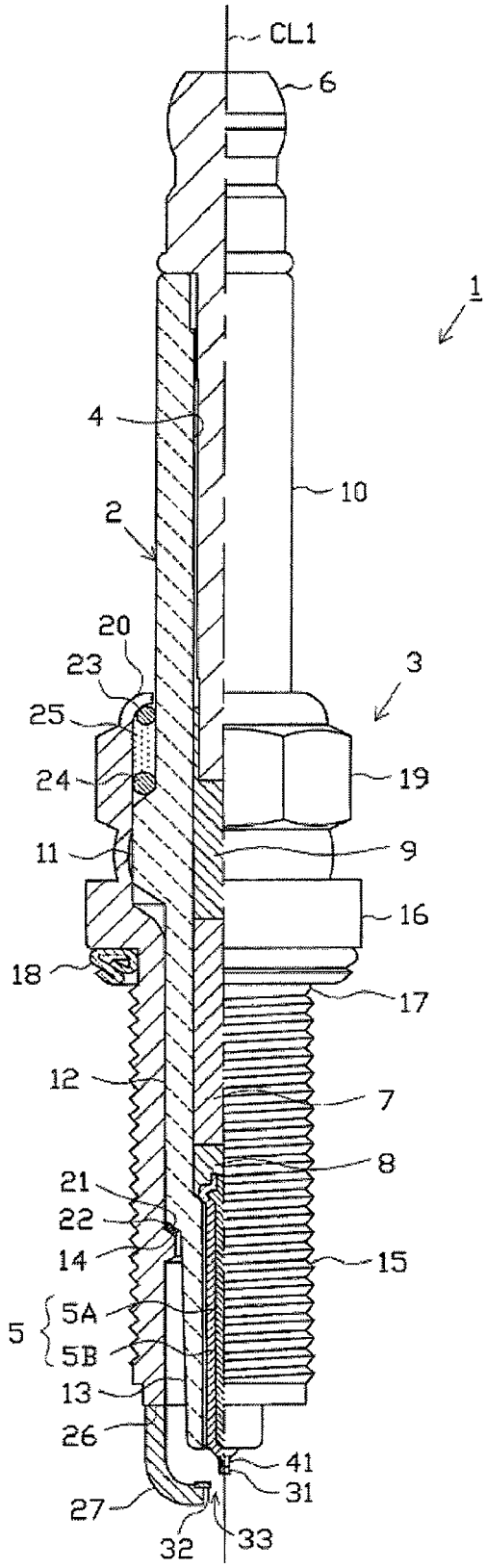
FIG. 1 is a partially broken front view showing the configuration of a spark plug of an embodiment of the invention.

Hereinafter, an embodiment will be described with reference to the drawings. FIG. 1 is a partially broken front view showing a spark plug 1. Note that in FIG. 1, a direction of an axis line CL1 of the spark plug 1 is referred to as a vertical direction in the drawing, a lower side is referred to as a front end side and an upper side is referred to as a rear end side of the spark plug 1.

The spark plug 1 includes an insulator 2 as a cylindrical insulator and a cylindrical metal shell 3 which holds the insulator 2.

As is known, the insulator 2 is formed by sintering alumina, etc. and includes on an external portion thereof a rear end side body portion 10 formed on a rear end side, a large diameter portion 11 which is formed to project radially outwards at a portion lying further forwards to a front end side than the rear end side body portion 10, and an intermediate body portion 12 which is formed thinner than the large diameter portion 11 at a portion lying further forwards to the front end side than the large diameter portion 11. Further, the insulator 2 includes a nose portion 13 which is formed into a tapering shape which tapers toward the front end side in the axis line CL1 direction at a portion lying further forwards to the front end side than the intermediate body portion 12. Of the insulator 2, the large diameter portion 11, the intermediate portion 12 and most of the nose portion 13 are accommodated in an interior of the metal shell 3. A tapering stepped portion 14 is formed at a connecting portion between the nose portion 13 and the intermediate portion 12, and the insulator 2 is locked in the metal shell 3 at the stepped portion 14.

Further, an axial hole 4 is formed so as to extend in the axis line CL1 in the insulator 2, and a center electrode 5 is inserted and fixed on a distal end side of the axial hole 4. The center electrode 5 has a rod shape (a cylindrical shape) as a whole, and a front end face of the center electrode 5 is formed flat. The center electrode 5 projects from a front end of the insulator 2. The center electrode 5 includes an inner layer 5A which is made of a copper or copper alloy and an outer layer 5B which is made of a Ni alloy whose main constituent is nickel (Ni). Further, a cylindrical noble metal portion 31 made of a noble metal alloy (an iridium alloy, for example) is provided at a front end portion of the center electrode 5. More specifically, the noble metal portion 31 is provided by forming a fused portion 41 by applying a laser welding to an outer circumference of an abutment plane between the outer layer 5B and the noble metal portion 31 (refer to FIG. 2 and the like).

A terminal electrode 6 is inserted and fixed on a rear end side of the axial hole 4 in such a state that the terminal electrode 6 projects from a rear end of the insulator 2.

Further, a cylindrical resistor 7 is disposed between the center electrode 5 and the terminal electrode 6 in the axial hole 4. Both end portions of the resistor 7 are electrically connected to the center electrode 5 and the terminal electrode 6 via conductive glass seal layers 8, 9, respectively.

Additionally, the metal shell 3 is formed of a metal such as a low-carbon steel into a cylindrical shape, and a thread portion (an external thread portion) 15 is formed on an outer circumferential surface of the metal shell 3 for mounting the spark plug 1 in an engine head. A seat portion 16 is formed on an outer circumferential surface of a rear end side of the thread portion 15, and a ring-shaped gasket 18 is fitted on a thread neck 17 at a rear end of the thread portion 15. Further, a tool engagement portion 19 having a hexagonal sectional shape is provided at a rear end side of the metal shell 3 for a tool such as a wrench to be brought into engagement therewith when the metal shell 3 is mounted in the engine head, and a crimping portion 20 is provided at rear end portion of the metal shell 3 for holding the insulator 2.

A tapering stepped portion 21 is provided on an inner circumferential surface of the metal shell 3 for locking the insulator 2. The insulator 2 is inserted from the rear end side of the metal shell 3 toward a front end side thereof and is fixed in place in such a state that the stepped portion 14 thereon is locked on the stepped portion 21 of the metal shell 3 by crimping an opening portion at the rear end side of the metal shell 3 radially inwards, that is, forming the crimping portion 20. Note that an annular plate packing 22 is interposed between both the stepped portions 14, 21 of the insulator 2 and the metal shell 3. By doing so, the airtightness of a combustion chamber is held so that a fuel-air mixture which penetrates between the nose portion 13 of the insulator 2 and the inner circumferential surface of the metal shell 3 is prevented from leaking to the outside of the spark plug 1.

Further, to make the closure by crimping more perfect, annular ring members 23, 24 are interposed between the metal shell 3 and the insulator 2, and powder of talc 25 is filled between the ring members 23, 24. Namely, the metal shell 3 holds the insulator 2 via the plate packing 22, the ring members 23, 24 and the talc 25.

A ground electrode 27, which is bent toward the center electrode 5 at an intermediate portion thereof, is joined to a front end face of a front end portion 26 of the metal shell 3. The ground electrode 27 has a noble metal tip 32 on an inner circumferential surface of a distal end portion thereof, and a distal end edge portion of the noble metal tip 32 and a front edge portion of the noble metal portion 31 face each other. Namely, a shortest distance between the center electrode 5 (the noble metal portion 31) and the ground electrode 27 (the noble metal tip 32) is formed between the front end edge portion of the noble metal portion 31 and a distal end edge portion of the noble metal tip 32, and hence, a spark discharge gap 33 is formed between the front end portion of the center electrode 5 and the distal end portion of the ground electrode 27 where a spark discharge is implemented in an oblique direction with respect to the axis line CL1.

Figure 2:
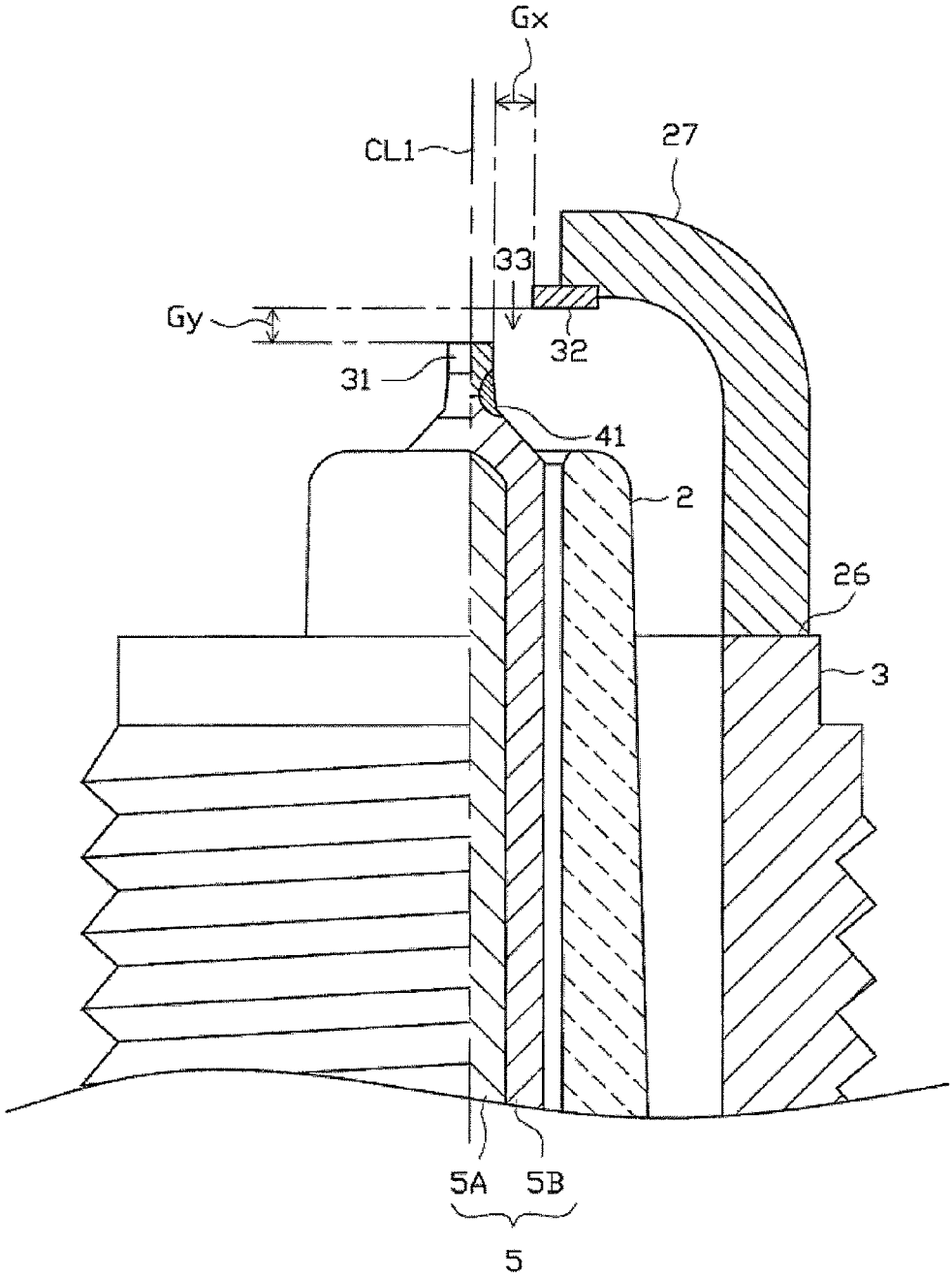
FIG. 2 is a partially broken enlarged front view showing the configuration of a front end portion of the spark plug.

Note that in a spark plug in which the front end face of the center electrode (a noble metal portion) and the side surface of the ground electrode face each other (for example, refer to JP-A-2007-234435), a spark is discharged substantially in an axial line direction. Namely, a size of the spark discharge gap unit a distance defined between both the electrodes in the axis line direction. In contrast to this, in the spark plug 1 according to the embodiment, since the spark is discharged in the oblique direction as has been described above, a size of the spark discharge gap 33 is determined by, as shown in FIG. 2, a distance Gx which is defined in a direction perpendicular to the axis line CL1 between both the electrodes 5, 27 and a distance Gy which is defined in the axis line CL1 between both the electrodes 5, 27. Because of this, to ensure a predetermined magnitude for the spark discharge gap 33, in bending the ground electrode 27 toward the center electrode 5 side, not only the distance Gy but also the distance Gx needs to adjusted accurately. Then, next, a bending apparatus 51, constituting a characteristic of the invention, will be described in detail which is used in a manufacturing process of the spark plug 1 not only to bend the ground electrode 27 toward the center electrode 5 side but also to form the spark discharge gap 33 to the predetermined magnitude.

Figure 3:
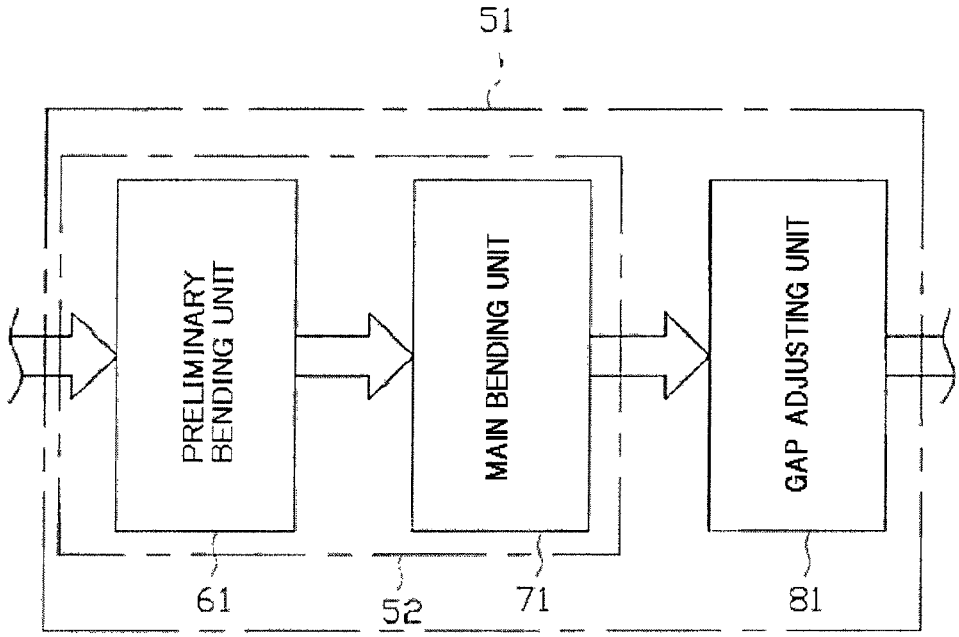
FIG. 3 is a block diagram showing the configuration of a bending unit.

As shown in FIG. 3, the bending apparatus 51 includes a bending unit 52 which includes, in turn, a preliminary bending unit 61 and a main bending unit 71 and a gap adjusting unit 81. In this embodiment, the spark plug 1 is held by a holding unit (not shown) so that its front end portion is oriented upwards and the axis line CL1 extends in a vertical direction and thereafter is transferred sequentially to the preliminary bending unit 61, the main bending unit 71 and the gap adjusting unit 81 in that order (in the order indicated by arrows in the figure). A positioning device (not shown) for positioning the ground electrode 27 in a certain circumferential position is provided on each of the units 61, 71, 81, so that the spark plug 1 is disposed in such a state that the circumferential position of the ground electrode 27 becomes constant in each of the units 61, 71, 81 by the positioning devices.

Figure 5:
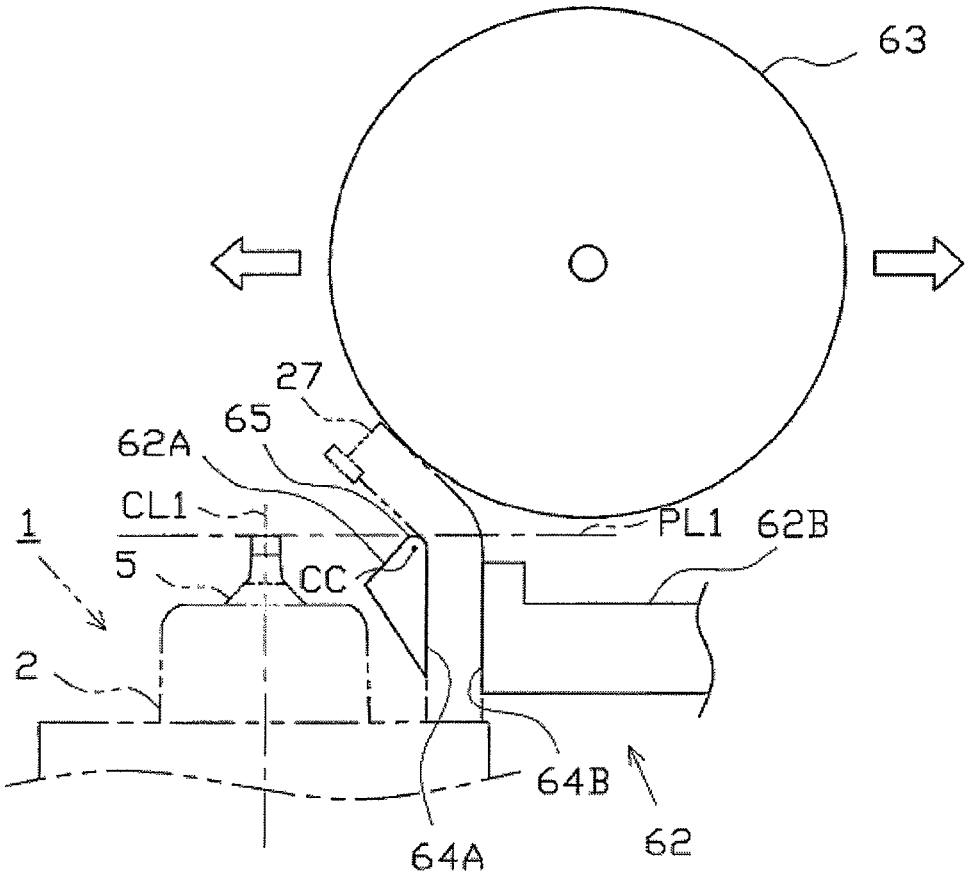

The preliminary bending unit 61 bends preliminarily the spark plug 1 including the ground electrode 27 which stays in a non-bent state (keeps a straight rod shape) at a position which corresponds to a bending portion (an intermediate portion) of the ground electrode 27, that is, implements a preliminary bending operation on the ground electrode 27. As shown in FIG. 5, the preliminary bending unit 61 includes a primary deformation preventing unit 62 for preventing the ground electrode 27 from inclining toward the center electrode 5 or a swelling of the ground electrode 27 toward an opposite side to the center electrode 5 and a roller 63 for bending the ground electrode 27.

The primary deformation preventing unit 62 includes a primary inner deformation preventing unit 62A and a primary outer deformation preventing unit 62B which are individually formed into a rod shape extending in a width direction of the ground electrode 27. The primary inner deformation preventing unit 62A and the primary outer deformation preventing unit 62B are made to move toward and away from the spark plug 1. In implementing a preliminary bending on the ground electrode 27, the primary inner deformation preventing unit 62A is disposed between a proximal end portion of the ground electrode 27 and a side portion of the center electrode 5, while the primary outer deformation preventing unit 62B is disposed so as to be brought into abutment with an outer surface of the proximal end portion of the ground electrode 27. Both the deformation preventing unit 62A, 62B include flat planar surface portions 64A, 64B. When carrying out the preliminary bending, the planar surface portions 64A, 64B are disposed so as to be brought into surface abutment with the proximal end portion of the ground electrode 27 while facing each other. Both the deformation preventing unit 62A, 62B are supported at their proximal end portions by a connecting portion in such a state that a space therebetween can be varied.

Although the primary inner deformation preventing unit 62A is configured so that a portion thereof which is brought into abutment with at least the ground electrode 27 has a triangular sectional shape, a curved surface portion 65 having a curved shape is provided at a portion which connects the planar surface portion 64A and a side surface which is positioned at an upper portion of a back side of the planar surface portion 64A. The curved surface portion 65 forms a portion against which an inner surface of the ground contact 27 is pressed when the ground electrode 27 is preliminarily bent by the roller 63 and has a shape which corresponds to a bent shape into which the ground electrode 27 is bent. Namely, the primary inner deformation preventing unit 62A includes a device for forming a brief shape of the bent shape of the ground electrode 27 and a device for preventing the ground electrode 27 from inclining toward the center electrode 5 which are integrated thereinto. In this embodiment, in applying the preliminary bending to the ground contact 27, the curved surface portion 65 is designed to be disposed so that a curvature center CC of thereof is positioned closer to the proximal end side of the ground electrode 27 in the axis line CL1 direction than a plane PL1 which includes the front end face of the center electrode 5 (the noble metal portion 31).

An outer circumferential surface of the roller 63 has a predetermined width (for example, 3 mm) and the roller 63 is supported so as to rotate freely. Additionally, the roller 63 is made to move in a horizontal direction (a direction indicated by arrows in the figure) by a moving unit, not shown, and hence, the roller 65 is made to move toward an opposite side surface of the ground electrode 27 to a side thereof which faces the center electrode 5 so as to press the same side surface. A layer (not shown) made of a diamond-like carbon (DLC) is formed on a portion on the outer circumferential surface of the roller 63 which can be brought into contact with the ground electrode 27 and a bearing portion of the roller 63, and a friction coefficient of a surface of the layer is referred to as 0.2 or smaller.

Figure 6:
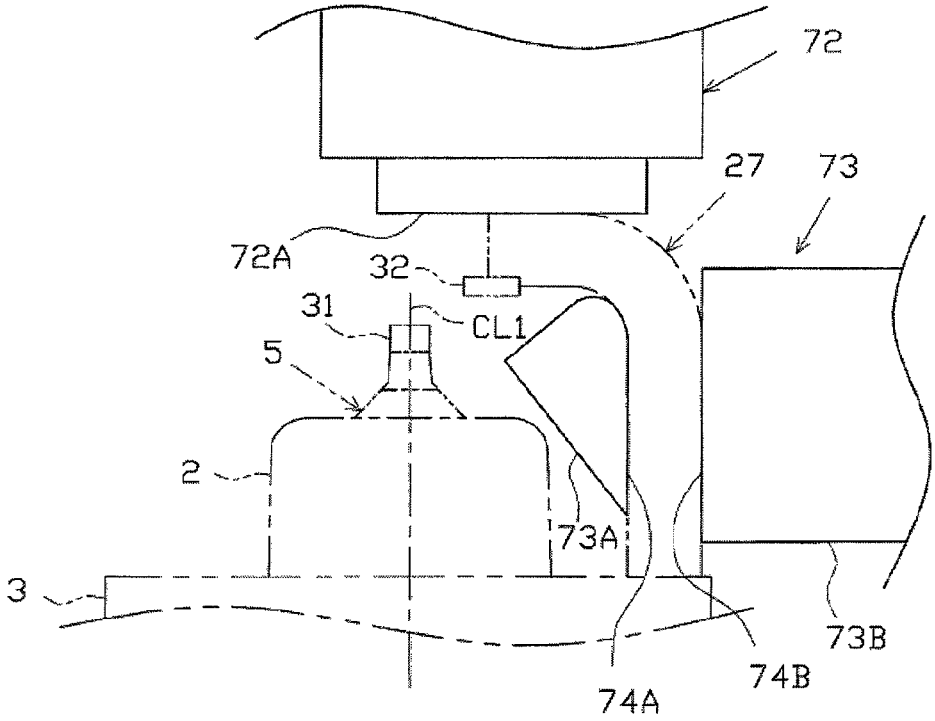
[FIG. 6 is an enlarged exemplary view showing a main bending unit.

The main bending unit 71 bends the ground electrode 27, on which the preliminary bending operation has been implemented, at a substantially right angle and adjusts a relative height position of the distal end portion of the ground electrode 27 (the noble metal tip 32) relative to the front end portion of the center electrode 5 (the noble metal portion 31) in the axis line CL1. As shown in FIG. 6, the main bending unit 71 includes a pressing unit 72 as a bending unit and a secondary deformation preventing unit 73 for preventing the deformation of the ground electrode 27.

The pressing unit 72 is made to move in the vertical direction (the axis line CL direction) and implements a main bending operation on the ground electrode 27 by pressing down the distal end portion of the ground electrode 27 toward the center electrode 5. A lower surface portion 72A of the pressing unit 72 which is brought into abutment with the ground electrode 27 at the time of main bending is formed flat, and a layer (not shown) made of DLC is formed on a surface of the lower surface portion 72A. Because of this, a friction coefficient of the lower surface portion 72A is made to be relatively small.

The secondary deformation preventing unit 73 includes a secondary inner deformation preventing unit 73A and a secondary outer deformation preventing unit 73B which are individually formed into a rod shape extending in the width direction of the ground electrode 27. The secondary inner deformation preventing unit 73A and the secondary outer deformation preventing unit 73B are made to move toward and away from the spark plug 1. In implementing a main bending on the ground electrode 27, the secondary inner deformation preventing unit 73A is disposed between the ground electrode 27 and the center electrode 5 so as to be brought into abutment with an inner surface of the proximal end portion of the ground electrode 27, while the secondary outer deformation preventing unit 73B is disposed so as to be brought into abutment with an outer surface of the proximal end portion of the ground electrode 27. Both the deformation preventing unit 73A, 73B include flat planar surface portions 73A, 73B, and when implementing the main bending, the planar surface portions 73A, 73B are disposed so as to be brought into surface abutment with the proximal end portion of the ground electrode 27. As a result, the deformation of the ground electrode 27 can be prevented in a more ensured fashion in implementing the main bending operation on the ground electrode 27. Both the deformation preventing unit 73A, 73B are supported at their proximal end portions by a connecting portion (not shown) in such a state that a space therebetween can be varied.

Further, the main bending unit 71 includes a primary illuminating unit (not shown) for emitting predetermined light onto a front end portion (at least the front end portion of the center electrode 5 and the distal end portion of the ground electrode 27) of the spark plug 1 and a primary image capturing unit (not shown) for capturing an image of the front end portion of the illuminated spark plug 1. The main bending unit 71 includes a control unit (not shown) for obtaining a magnitude of a gap between both the electrodes 5, 27 (the noble metal portion 31 and the noble metal tip 32) from the captured image data that is captured by the primary image capturing unit, calculating a pressing amount (corresponding to an amount resulting when a spring-back amount is added to an error amount, which will be described later) by the pressing unit 72 based on the magnitude of the gap so obtained and controlling the pressing unit 72 based on the pressing amount so calculated. Here, operations controlled by the control unit will be described in detail as follows.

Namely, the control unit calculates an error amount of the obtained magnitude of the gap in the vertical direction between both the electrodes 5, 27 relative to a designed magnitude of the spark discharge gap 33 defined in the axis line CL1 direction. Then, a main bending operation is implemented on the ground electrode 27 by pressing down the ground electrode 27 by the amount resulting when the spring-back amount is added to the error amount by the pressing unit 72. By doing this, the spark discharge gap 33 is formed so that the relative height position of the distal end portion (the noble metal tip 32) of the ground electrode 27 to the front end portion (the noble metal portion 31) of the center electrode 5 substantially equals the designed relative height position of the distal end portion of the ground electrode 27 to the front end portion of the center electrode 5. Namely, the spark discharge gap 33 is formed so that the distance Gy of the spark discharge gap 33 which is defined in the axis line CL1 direction equals the designed distance Gy.

Figure 7A:
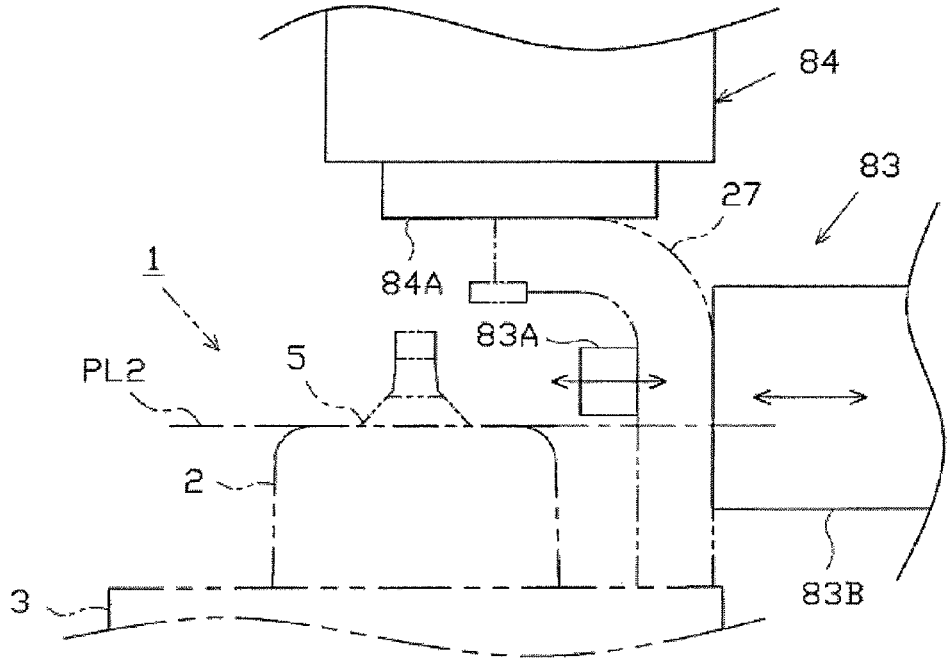
FIG. 7A is an exemplary front view showing the configuration of a gap adjusting unit.
Figure 7B:
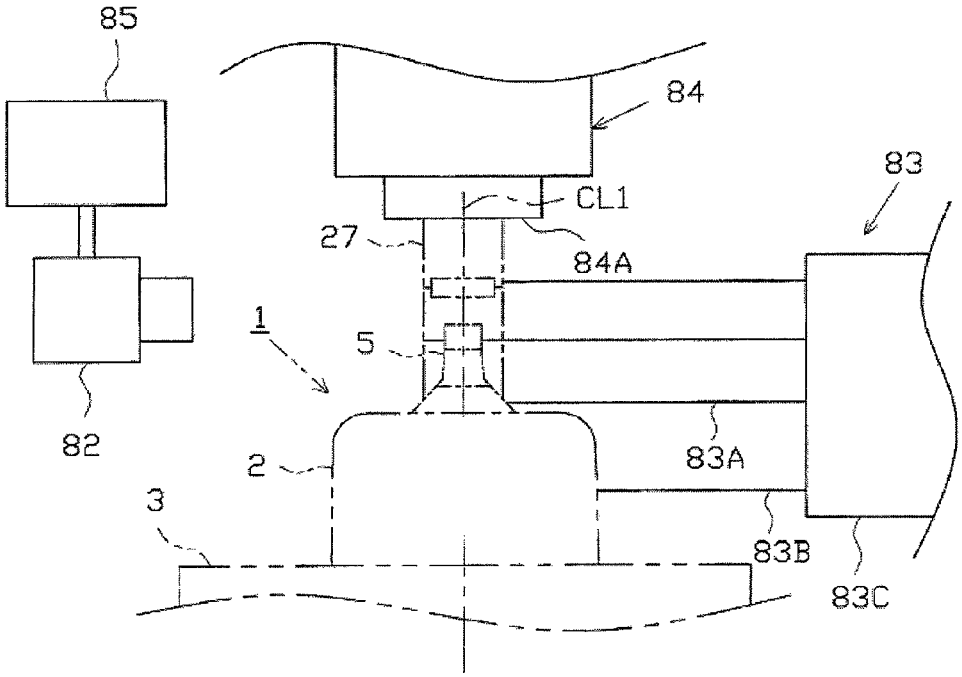
FIG. 7B is an exemplary side view of the gap adjusting unit.
Figure 8:
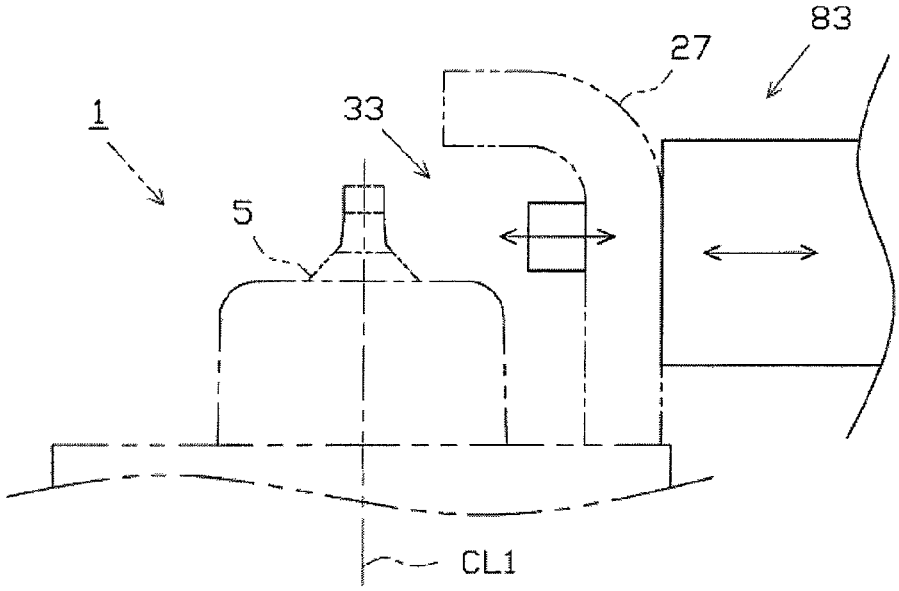
FIG. 8 is an enlarged front view illustrating a method for adjusting a magnitude of a spark discharge gap which is defined in a direction perpendicular to an axis line.

The gap adjusting unit 81 adjusts the distance Gx of the spark discharge gap 33 which is defined in a direction perpendicular to the axis line CL1 while maintaining the distance Gy of the spark discharge gap 33 which is defined in the axis line CL1 by the main bending unit 71. As shown in FIG. 7, the gap adjusting unit 81 includes a gap adjusting unit 83, a restricting unit 84, an image processing unit 85 and a secondary illuminating unit (not shown) for emitting predetermined light on to the front end portion of the spark plug 1.

The secondary image capturing unit 82 captures an image of the front end portion of the spark plug 1 illuminated by the secondary illuminating unit and outputs the captured image data that is so obtained to the image processing unit 85.

The gap adjusting unit 83 includes rod-shaped arms 83A, 83B which each have a rectangular sectional shape and extend in the width direction of the ground electrode 27 and a connecting portion 83*c* which supports both the arms 83A, 83B in such a state that both the arms 83A, 83B can move in a horizontal direction (a direction indicated by arrows in FIG. 7). The gap adjusting unit 83 is made to move toward and away from the spark plug 1 transferred thereto. When adjusting the distance Gx, both the arms 83A, 83B move toward the spark plug 1 and the ground electrode 27 is held by both the arms 83A, 83B therebetween. Then, the gap adjusting unit 83 can adjust the distance Gx by moving both the arms 83A, 83B horizontally.

The arm 83A is formed relatively thinner than the arm 83B, and the arm 83A is disposed closer to the front end side of the spark plug 1 in the axis line CL1 direction than a plane PL2 which includes a front end face of the insulator 2. Namely, the arm 83A is disposed in a relatively large space defined between the center electrode 5 and the ground electrode 27.

The restricting unit 84 is controlled by the image processing unit 85 and a lower surface portion 84A thereof is formed flat. Additionally, a layer (not shown) of DLC is formed on the lower surface portion 84A, and a friction coefficient of a surface of the layer is referred to as 0.2 or smaller. The restricting unit 84 is made to move in the vertical line (the axis line CL1 direction), and when adjusting the distance Gx, the lower surface portion 84A is disposed in a position where it is brought into abutment with the distal end portion of the ground electrode 27 in an unmoving state.

The image processing unit 85 controls operations of the gap adjusting unit 83 and the restricting unit 84 based on the captured image data that is captured by the secondary image capturing unit 82. More specifically, the image processing unit 85 moves both the arms 83A, 83B horizontally by an amount resulting when a spring-back amount is added to an error amount of the distance that is obtained from the captured image data as being defined in the horizontal direction between the distal end portion of the ground electrode 27 and the front end portion of the center electrode 5 relative to the designed distance Gx of the spark discharge gap 33 which is defined in the direction perpendicular to the axis line CL1.

In this embodiment, after the distance Gx is adjusted in consideration of a spring back deformation of the ground electrode 27 by the gap adjusting unit 83, the gap adjusting unit 83 and the restricting unit 84 are withdrawn from the spark plug 1. Thereafter, an image of the spark plug 1 is captured again by the image capturing unit 82, so as to verify whether or not the distance Gx and the distance Gy of the spark discharge gap 33 are equal to the designed magnitudes. Here, in the event that the distance Gx and the distance Gy are formed substantially as designed, the bending operation of the ground electrode 27 is completed. On the other hand, in the event that the distance Gx and the distance Gy differ from the designed magnitudes, the distance Gx is readjusted by the gap adjusting unit 83, and the distance Gy is readjusted by the restricting unit 84. Namely, the restricting unit 84 of this embodiment is made not only to restrict the relative movement of the distal end portion of the ground electrode 27 relative to the center electrode 5 in the axis line CL1 direction but also to adjust the distance Gx by pressing the distal end portion of the ground electrode 27 toward the center electrode 5.

Next, a bending method of the ground electrode 27 using the bending apparatus 51 will be described.

Figure 4:
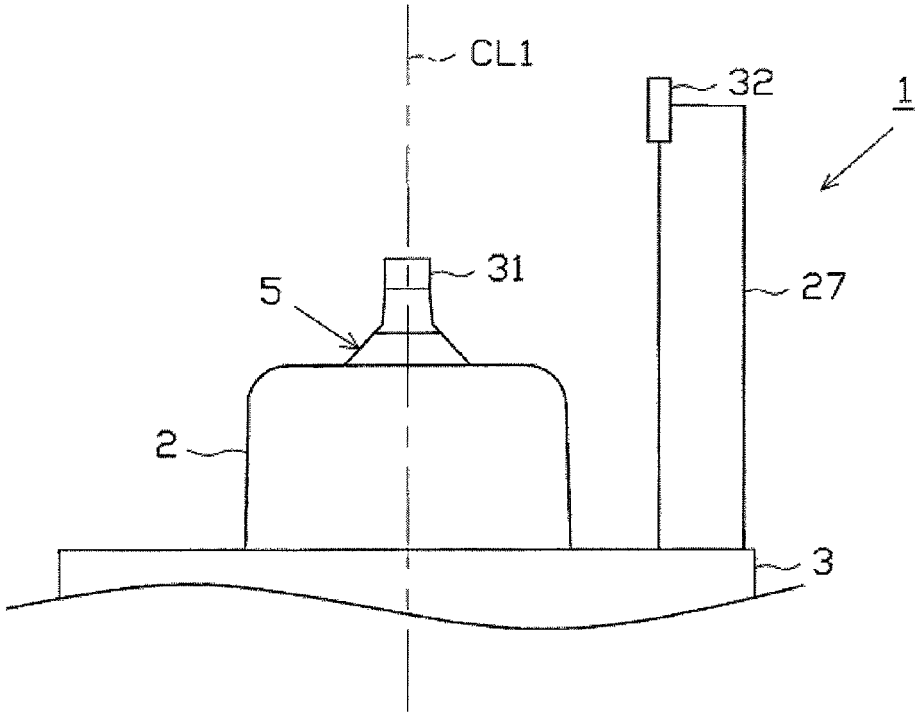
FIG. 4 is a partially enlarged view showing the spark plug having a ground electrode before bending.

Firstly, the spark plug 1 on which the ground electrode 27 is positioned (refer to FIG. 4) is transferred to the preliminary bending unit 61 by the transfer unit. Then, the primary deformation preventing unit 62 moves toward the spark plug 1 and the proximal end portion of the ground electrode 27 is supported by the primary deformation preventing unit 62. Following this, the roller 63 moves toward the ground electrode 27, and the ground electrode 27 is pressed against by the curved surface portion 65, whereby a preliminary bending operation is implemented on the ground electrode 27. Thereafter, the primary deformation preventing unit 62 and the roller 63 are withdrawn from the spark plug 1.

Next, the spark plug on which the preliminary bending has been implemented is transferred to the main bending unit 71. Then, an image of the front end portion of the spark plug 1 illuminated by the primary illuminating unit is captured by the primary image capturing unit, and a pressing amount is calculated based on the captured image data by the control unit. Following this, the secondary deformation preventing unit 73 moves toward the spark plug 1, and the proximal end portion of the ground electrode 27 is supported by the secondary deformation preventing unit 73. Then, the distal end portion of the ground electrode 27 is pressed by the pressing amount by the pressing unit, whereby a main bending operation is implemented on the ground electrode 27. By doing so, the ground electrode 27 is bent substantially at a right angle, and the distance Gy of the spark discharge gap 33 which is defined in the axis line CL1 direction is formed. After the implementation of the main bending, the pressing unit 72 and the secondary deformation preventing unit 73 are withdrawn from the spark plug 1.

Next, the spark plug 1 on which the main bending has been implemented is transferred to the gap adjusting unit by the transfer unit, and an image of the front end portion of the spark plug 1 illuminated by the secondary illuminating unit is captured by the secondary image capturing unit 82. Then, the gap adjusting unit 83 and the restricting unit 84 are disposed in the predetermined positions by the image processing unit 85 based on the captured image data that is captured by the secondary image capturing unit 82. Following this, the distance Gx is adjusted by the gap adjusting unit 83 while the distance Gy is maintained by the restricting unit 84. Thereafter, the gap adjusting unit 83 and the restricting unit 84 are withdrawn from the spark plug 1, and an image of the front end portion of the spark plug 1 is captured again by the secondary image capturing unit 82. Then, the distance Gx and the distance Gy are readjusted as required based on the captured image data that has been so recaptured by the gap adjusting unit 83 and the restricting unit 84, respectively. As a result, the spark discharge gap 33 is formed in the predetermined magnitude (as substantially designed), and the bending of the ground electrode 27 is completed.

Thus, as has been described in detail, according to the bending apparatus 51 of the embodiment, in the bending unit 52, the relative height position of the distal end portion of the ground electrode 27 to the front end portion of the center electrode 5, that is, the magnitude of the spark discharge gap 33 which is defined in the axis line CL1 direction is adjusted. In the gap adjusting unit 81, the magnitude of the spark discharge gap 33 which is defined in the direction perpendicular to the axis line CL is adjusted. Because of this, the spark discharge gap 33 can be formed with good accuracy.

On the other hand, by adjusting the magnitude of the spark discharge gap 33 which is defined in the direction perpendicular to the axis line CL1 by the gap adjusting unit 81, there is a fear that an error is produced in the magnitude of the spark discharge gap 33 which is defined in the axis line CL1. In this respect, according to the embodiment, the relative movement of the ground electrode 27 in the axis line CL1 direction can be restricted by the restricting unit 84. Because of this, the production of an error in the magnitude of the spark discharge gap 33 defined in the axis line CL1 which is adjusted at the bending unit 52 can be prevented in a more ensured fashion, thereby making it possible to form the spark discharge gap 33 with sufficient accuracy.

Not only the restriction of the relative movement of the ground electrode 27 in the axis line CL1 direction but also the adjustment of the magnitude of the spark discharge gap defined in the axis line CL1 direction can be implemented by the restricting unit 84. Because of this, since the magnitude of the spark discharge gap 33 defined in the axis line CL1 direction can be adjusted by the gap adjusting unit 81 in addition to the magnitude defined in the direction perpendicular to the axis line CL1, the spark discharge gap 33 can be formed with far better accuracy.

The layer made of the diamond-like carbon is formed on the portion of the restricting unit 84 which is brought into abutment with the ground electrode 27, and the friction coefficient of the abutment portion with the ground electrode 27 is made relatively small. By doing so, the ground electrode 27 can effectively be prevented from being damaged by the restricting unit 84.

Further, according to the bending apparatus 51 of the embodiment, when implementing the preliminary being operation, the curved surface forming unit (the curved surface portion 65) is disposed between the proximal end portion of the ground electrode 27 and the side portion of the center electrode 5. Namely, since the curved surface portion 65, which forms a reference for the bending position of the ground electrode 27, is disposed in the position lying closer to the distal end side of the ground electrode 27 (in the position closer to the metal shell 3) without being interrupted by the center electrode 5, the ground electrode 27 can easily be bent on the proximal end portion side thereof. Consequently, in a so-called spark plug of oblique discharge type or a so-called spark plug of transverse discharge type in which the ground electrode 27 needs to be bent in the position closer to the proximal end side thereof, it is more effective to adopt the preliminary bending unit 61 of the embodiment.

The preliminary bending operation is implemented on the ground electrode 27 by the roller 63 which is supported so as not only to move relatively to the ground electrode 27 in the direction perpendicular to the axis line CL1 but also to rotate freely. Because of this, the ground electrode 27 can be pressed against the curved surface portion 65 in a more ensured fashion without changing the pressing direction of the ground electrode. Since the roller 63 is supported so as to rotate freely, the occurrence of a situation in which the ground electrode 27 is bent while rubbing on the roller 63 can be suppressed to an extreme extent, whereby the ground electrode 27 can be prevented from being damaged by the roller 63 in a more ensured fashion.

Further, in this embodiment, in order to maintain the friction coefficients of the portion on the outer circumferential surface of the roller 63 which is easily brought into contact with the ground electrode 27 and the bearing portion of the roller 63 at relatively low levels, the layers made of DLC are provided on the outer circumferential surface and the bearing portion of the roller 63. By doing so, the ground electrode 27 can be prevented from being damaged by the roller 63 in a far more ensured fashion.

Additionally, in the preliminary bending unit 61, the curved surface portion 65 which is disposed between the ground electrode 27 and the center electrode 5 and the primary inner deformation preventing unit 62A are integrated together. Because of this, the preliminary bending unit 61 can be prevented from getting complex.

The curved surface portion 65 is disposed so that the curvature center CC of the curved surface portion 65 is positioned closer to the proximal end side of the ground electrode 27 in the axis line CL1 direction than the flat plane PL1 which includes the front end face of the center electrode 5. Consequently, the ground electrode 27 can bent in the position lying closer to the proximal end side thereof, thereby making it possible to manufacture a spark plug of transverse discharge type or a spark plug of oblique discharge type relatively easily.

The arm 83A is disposed closer to the distal end side of the ground electrode 27 in the axis line CL1 direction or in the relatively large space defined between the center electrode 5 and the ground electrode 27. Consequently, the restriction of the relative movement of the ground electrode 27 toward the center electrode 5 by the existence of the arm 83A can be suppressed, whereby the magnitude of the spark discharge gap 33 can be adjusted more easily and more accurately.

Note that the invention is not limited to what has been described in the embodiment, and hence, the invention may be carried out as will be described blow, for example. Of course, other application examples and modified examples which will not be described in the following description will also be possible naturally.

(a) In the embodiment, while the primary deformation preventing unit 62 includes the primary inner deformation preventing unit 62A and the primary outer deformation preventing unit 62B, the primary deformation preventing unit 62 may be made to include only either of the primary inner deformation preventing unit 62A and the primary outer deformation preventing unit 62B.

(b) In the embodiment, while the roller 63 is adopted as the primary bending unit for implementing the preliminary bending operation on the ground electrode 27, the unit for implementing the preliminary bending operation on the ground electrode 27 is not limited thereto.

(c) In the embodiment, while the layers made of DLC are provided on the outer circumferential surface of the roller 63 and the lower surface portion 84A of the restricting unit 84, those layers may not be provided.

(d) In the embodiment, while the straight rod-shaped ground electrode 27 is bent after the metal shell 3 to which the straight rod-shaped ground electrode 27 is joined and the insulator 2 in which the center electrode 5 is provided are assembled together, the ground electrode 27 may be bent in a prior stage to the assemblage of the metal shell 3 and the insulator 2.

(e) In the embodiment, while the spark plug 1 is a spark plug of oblique discharge type in which a spark is discharged obliquely relative to the axis line CL1 direction, the spark discharge direction of the spark plug 1 is not limited thereto. Consequently, the spark plug 1 may be a spark plug of transverse discharge type in which a spark is discharged in the direction substantially perpendicular to the axis line CL1 direction or a spark plug of longitudinal discharge type in which a spark is discharged substantially in the axis line CL1 direction.

(f) In the embodiment, while the invention is embodied into the embodiment in which the ground electrode 27 is joined to the front end face of the front end portion 26 of the metal shell 3, the invention can also be applied to an embodiment in which a ground electrode is formed by cutting out part of the metal shell (or part of a front end metallic member welded in advance to the metal shell) (for example, JP-A-2006-236906). The ground electrode 27 may be joined to a side surface of the front end portion 26 of the metal shell 3.

(g) In the embodiment, while the tool engagement portion 19 is illustrated as having the hexagonal sectional shape, as to the shape of the tool engagement portion 19, the invention is not limited to the shape described. For example, the tool engagement portion 19 may have a Bi-HEX (modified dodecagonal) shape [ISO22977:205(E)] or the like.

(h) The positions where to dispose the primary inner deformation preventing unit 62A and the primary outer deformation preventing unit 62B when the preliminary bending operation is implemented may be determined based on the captured image data of the front end portion of the spark plug 1.

(i) In the embodiment, while the primary inner deformation preventing unit 62A and the primary outer deformation preventing unit 62B, the secondary inner deformation preventing unit 73A and the secondary outer deformation preventing unit 73B, and the arm 83A and the arm 83B individually include the separate members, they may individually include a single member.

(j) In the embodiment, while the gap adjusting unit 83 takes the form which holds the distal end portion of the ground electrode 27, as the gap adjusting unit, a form may be adopted which presses against a distal end face of the ground electrode 27 (in the case of the ground electrode 27 having the noble metal tip 32, a distal end face of a base material of the ground electrode excluding the noble metal tip 32).

Figure 9A:
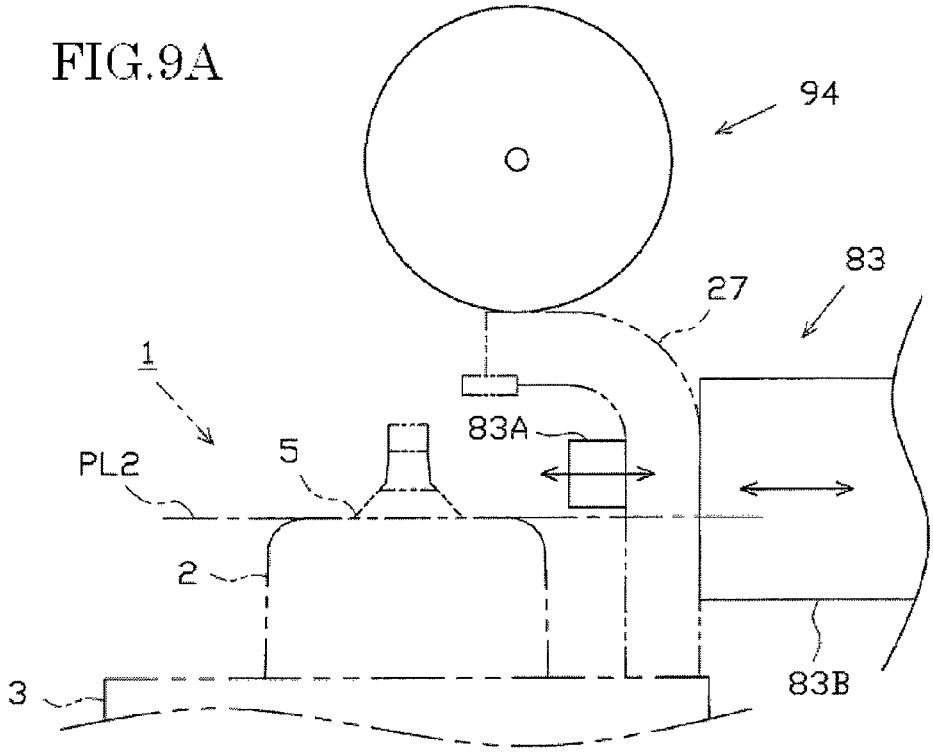
FIGS. 9A and 9B are exemplary front views showing the configuration of a restricting unit in another embodiment.
Figure 9B:
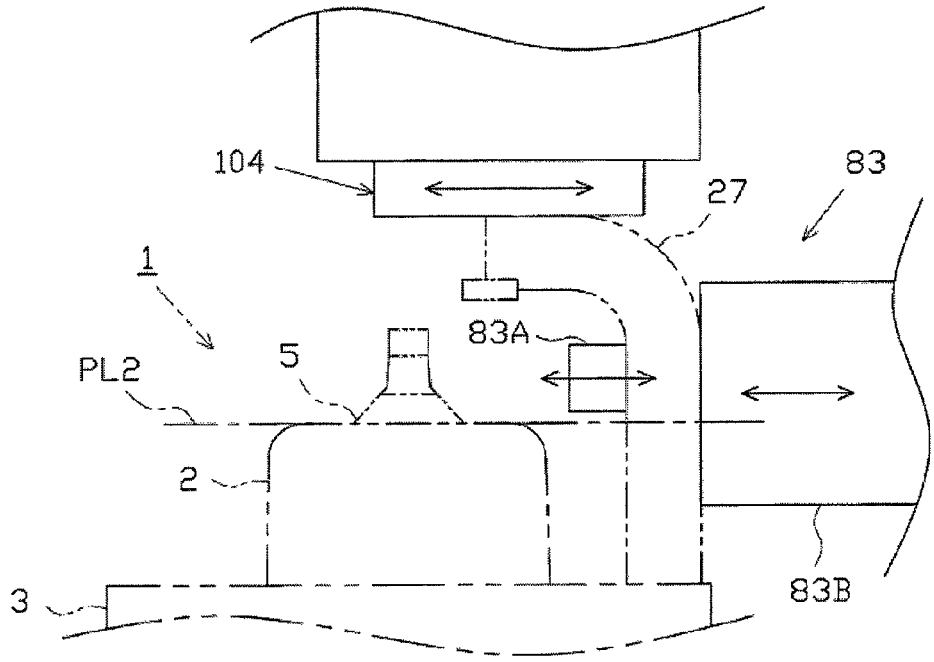

In the embodiment, the distance Gx is adjusted by the gap adjusting unit 83 while maintaining the distance Gy by bringing the distal end portion of the ground electrode 27 into contact with the lower surface portion 84A of the restricting unit 84 which has the relatively low friction coefficient. Namely, a surface of the ground electrode 27 is designed to rub against the lower surface portion 84A of the restricting unit 84 when adjusting the distance Gx. In contrast to this, As shown in FIG. 9(*a*), a restricting unit 94 may be designed to include a roller which can rotate freely or can rotate in association with the movement of the ground electrode 27. As shown in FIG. 9(*b*), a restricting unit 104 may be designed to move in synchronism with the movement of the gap adjusting unit 83. In this case, when adjusting the distance Gx, the generation of friction between the restricting unit 94, 104 and the ground electrode 27 can be prevented in a more ensured fashion. Because of this, the ground electrode 27 can be prevented from being damaged on the surface thereof in a far more ensured fashion.

DESCRIPTION OF REFERENCE NUMERALS

1 spark plug; 2 insulator as insulator; 3 metal shell; 4 axial hole; 5 center electrode; 26 front end portion of metal shell; 27 ground electrode; 33 spark discharge gap; 51 bending apparatus; 52 bending unit; 61 preliminary bending unit; 71 main bending unit; 72 pressing unit as bending unit; 81 gap adjusting unit; 83 gap adjusting unit; 84, 94, 104 restricting unit.

The invention claimed is:

1. A spark plug manufacturing method for manufacturing a spark plug including:

a rod-like center electrode extending in an axis line direction;

a substantially cylindrical insulator having an axial hole extending in the axis line direction, the center electrode being provided at a front end side of the axial hole;

a substantially cylindrical metal shell provided on an outer circumference of the insulator; and a ground electrode which includes a proximal end portion joined to the metal shell, an intermediate portion bent so as to form a spark discharge gap between a distal end portion of the ground electrode and a front end portion of the center electrode, the spark plug manufacturing method comprising:

pressing the distal end portion of the ground electrode toward the center electrode by a bending unit so that the ground electrode is bent to adjust a relative height position of the distal end portion of the ground electrode in the axis line direction relative to the front end portion of the center electrode; and adjusting a magnitude of the spark discharge gap which is defined in a direction perpendicular to the axis line by use of a gap adjusting unit for moving the distal end portion of the ground electrode relative to the center electrode, while a restricting unit restricts the relative movement of the distal end portion of the ground electrode relative to the center electrode in the axis line direction, and during the pressing step and the adjusting step, an inner deformation preventing unit of a deformation preventing unit for preventing deformation of the ground electrode is brought into abutment with an inner surface of the proximal end portion of the ground electrode, and an outer deformation preventing unit of the deformation preventing unit is brought into abutment with an outer surface of the proximal end portion of the ground electrode.

2. The spark plug manufacturing method according to claim 1, wherein the restricting unit abuts and slides on a side surface of the distal end portion of the ground electrode opposite to a side of the distal end portion which faces the center electrode to restrict the relative movement of the ground electrode relative to the center electrode, and a layer having a small friction coefficient is formed on a portion of the restricting unit where the ground electrode is brought into abutment and slides.

3. The spark plug manufacturing method according to claim 1, wherein the restricting unit is a roller which can rotate, and the relative movement of the distal end portion of the ground electrode relative to the center electrode in the axis line direction is restricted by bringing an outer circumferential surface of the roller into abutment with a side surface of the distal end portion of the ground electrode opposite to a side of the distal end portion which faces the center electrode.

4. The spark plug manufacturing method according to claim 1, wherein the restricting unit is made to be movable in synchronism with movement of the gap adjusting unit.

5. The spark plug manufacturing method according to claim 1, wherein in the spark plug, a shortest distance between the center electrode and the ground electrode is formed between a front end edge portion of the center electrode or a side surface portion of the center electrode and the distal end portion of the ground electrode.

6. The spark plug manufacturing method according to claim 1, wherein a clearance is formed between the front end portion of the center electrode and the distal end portion of the ground electrode both in the axis line direction and in the direction perpendicular to the axis line.

7. The spark plug manufacturing method according to claim 6, wherein the restricting unit can adjust the magnitude of the spark discharge gap which is defined in the axis line direction.

8. A spark plug manufacturing apparatus for use in manufacturing a spark plug including:

a rod like center electrode extending in an axis line direction;

a substantially cylindrical insulator having an axial hole extending in the axis line direction, the center electrode being provided at a front end side of the axial hole;

a substantially cylindrical metal shell provided on an outer circumference of the insulator; and a ground electrode which includes a proximal end portion joined to the metal shell, and an intermediate portion bent so as to form a spark discharge gap between a distal end portion of the ground electrode and a front end portion of the center electrode, the spark plug manufacturing apparatus comprising:

a bending unit for bending the ground electrode, which has a straight rod shape, toward the axis line so as to adjust a relative height position of the distal end portion of the ground electrode to the front end portion of the center electrode in the axis line direction;

a gap adjusting unit configured to adjust a magnitude of the spark discharge gap which is defined in a direction perpendicular to the axis line, wherein the bending unit includes a bending unit configured to press the distal end portion of the ground electrode toward the center electrode; and a deformation preventing unit configured to prevent deformation of the ground electrode during pressing of the distal end portion of the ground electrode toward the center electrode and adjusting the magnitude of the spark discharge gap, wherein the deformation unit includes:

an inner deformation preventing unit configured to be brought into abutment with an inner surface of the proximal end portion of the ground electrode, and an outer deformation preventing unit configured to be brought into abutment with an outer surface of the proximal end portion of the ground electrode, and wherein the gap adjusting unit includes:

a gap adjusting unit configured to move the distal end portion of the ground electrode relative to the center electrode in a direction substantially perpendicular to the axis line; and a restricting unit configured to restrict the relative movement of the distal end portion of the ground electrode relative to the center electrode in the axis line direction.

9. The spark plug manufacturing apparatus according to claim 8, wherein the restricting unit abuts and slides on a side surface of the distal end portion of the ground electrode opposite to a side of the distal end portion which faces the center electrode to restrict the relative movement of the ground electrode relative to the center electrode, and a layer having a small friction coefficient is formed on a portion of the restricting unit where the ground electrode is brought into abutment and slides.

10. The spark plug manufacturing apparatus according to claim 8, wherein the restricting unit is a roller which can rotate, and the relative movement of the distal end portion of the ground electrode relative to the center electrode in the axis line direction is restricted by bringing an outer circumferential surface of the roller into abutment with a side surface of the distal end portion of the ground electrode opposite to a side of the distal end portion which faces the center electrode.

11. The spark plug manufacturing apparatus according to claim 8, wherein the restricting unit is made to be movable in synchronism with movement of the gap adjusting unit.

12. The spark plug manufacturing apparatus according to claim 8, wherein in the spark plug, a shortest distance between the center electrode and the ground electrode is formed between a front end edge portion of the center electrode or a side surface portion of the center electrode and the distal end portion of the ground electrode.

13. The spark plug manufacturing method according to claim 8, wherein a clearance is formed between the front end portion of the center electrode and the distal end portion of the ground electrode both in the axis line direction and in the direction perpendicular to the axis line.

14. The spark plug manufacturing apparatus according to claim 13, wherein the restricting unit can adjust the magnitude of the spark discharge gap which is defined in the axis line direction.

* * * * *